US005238318A

United States Patent [19]

Chen

[11] Patent Number: 5,238,318

[45] Date of Patent: Aug. 24, 1993

[54] CONTROL APPARATUS FOR A TYPING/READING AID DEVICE

[76] Inventor: Yao K. Chen, 1st Fl., No. 132, I An Rd., Chung Ho City, Taipei Hsien, Taiwan

[21] Appl. No.: 939,154

[22] Filed: Sep. 2, 1992

[51] Int. Cl.[5] ..... B41J 29/15

[52] U.S. Cl. ..... 400/718.1; 400/718.2; 40/352

[58] Field of Search ..... 400/718.1, 718.2; 40/352, 353, 356

[56] References Cited

U.S. PATENT DOCUMENTS

| | | | |
|---|---|---|---|
| 3,713,525 | 1/1973 | Troing | 400/718.1 |
| 3,763,989 | 10/1973 | Goldman | 400/718.1 |
| 4,043,064 | 8/1977 | Friedman | 400/718.2 |
| 5,040,913 | 8/1991 | Folkens et al. | 400/718.1 |

FOREIGN PATENT DOCUMENTS

| | | | |
|---|---|---|---|
| 439398 | 7/1991 | European Pat. Off. | 400/718.1 |
| 1935855 | 3/1978 | Fed. Rep. of Germany | 400/718.1 |
| 3317709 | 11/1984 | Fed. Rep. of Germany | 400/718.1 |
| 29184 | 2/1984 | Japan | 400/718.1 |

*Primary Examiner*—David A. Wiecking
*Assistant Examiner*—Steven S. Kelley
*Attorney, Agent, or Firm*—Morton J. Rosenberg; David I. Klein

[57] ABSTRACT

A control apparatus for a typing/reading aid device controls a ruler to move along a frame board in steps according to a user-defined line-space unit set by a plurality of switches. The control apparatus is also allowed to be connected between a keyboard and a computer, thus permitting a user to define some function keys on the keyboard to control the movement of the ruler on the frame board.

1 Claim, 6 Drawing Sheets

CONTROL APPARATUS FOR A TYPING/READING AID DEVICE

FIELD OF THE INVENTION

This invention relates to a control apparatus for a typing/reading aid device and especially to one which is able to link with a computer/keyboard system to be independently used by a user.

BACKGROUND OF THE INVENTION

There are different types of typing/reading aid devices used at the present time have different types, such as one which has a copy holder and a ruler slidably mounted on the copy holder such that a user can manually position the ruler when reading a script (draft) on the copy holder. This kind of typing/reading aid device requires the user to continuously adjust the ruler to keep pace with typing text, thereby causing inconvenience. A more advanced typing/reading aid device utilizes a motor in cooperation with a controlling/driving device and a foot switch such that the user only needs to step (depress) the foot switch to position the ruler to wherever he wants. However, the movement controlled by foot is not sensitive enough, thus the user might have to readjust the ruler several times to position the ruler at the right place.

SUMMARY OF THE INVENTION

The primary objective of the present invention is to provide a control apparatus for a typing/reading aid device, which allows a user to manually control the movement of the ruler and also allows the user to control the ruler via a computer/keyboard thus providing convenience for the user to control the movement of the typing/reading device.

In accordance with one aspect of the invention, a control apparatus for a typing/reading aid device provides a line-space setting function for a user to set an appropriate line-space and a central controlling means including a program therein for responding to the line-space set by the user, enabling a ruler of the typing/-reading aid device to move by the line-space.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 7:
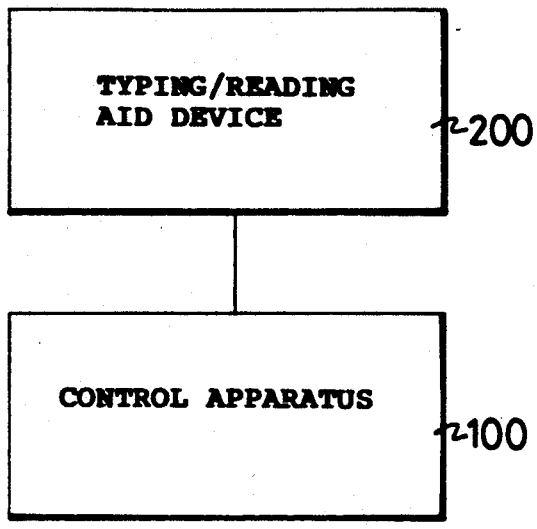
FIG. 7 illustrates a schematic view of the control apparatus of the present invention linking with a typing/reading aid device.
Figure 8:
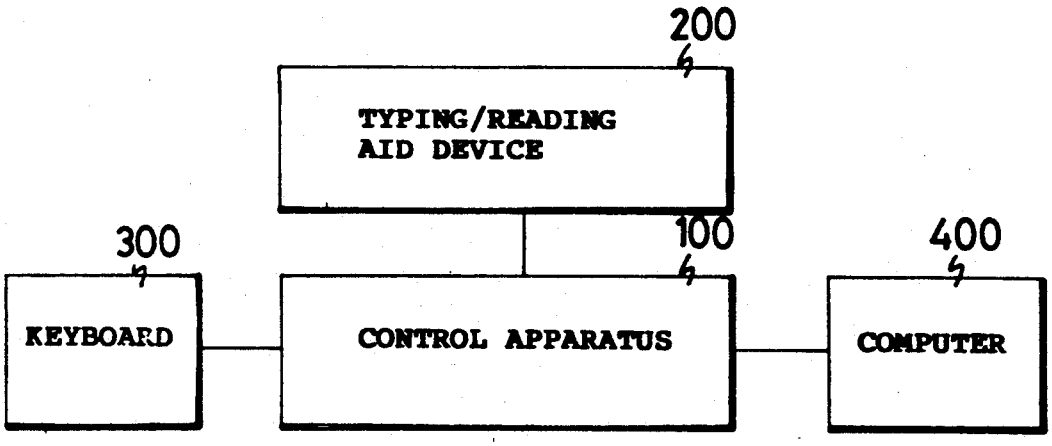
FIG. 8 illustrates another schematic view of the control apparatus of the present invention linking with a typing/reading aid device, a keyboard, and a computer.

Referring to FIG. 7, a first embodiment of the present invention is permitted to be used independently, i.e. the operation of the typing/reading aid device 200 is manually controlled by several switches on a control apparatus 100 of the present invention, as described in detail later. Referring to FIG. 8, a second embodiment of the present invention links the control apparatus 100 between a typing/reading aid device 200, a keyboard 300, and a computer 400. The hardware of the two embodiments are almost the same, while the same software can serve both embodiments. The hardware forming the first embodiment is described in the following paragraphs.

Basically the typing/reading aid device 200 has a ruler (not shown) slidably mounted on a frame board (not shown) and the ruler is transmitted by a transmitting chain or the like. The chain is activated by a motor and the latter is further controlled by a control apparatus as will be described in the present invention. Because the mechanical portion as mentioned above is well known and is not claimed herein, it is not described hereafter.

Figure 1:
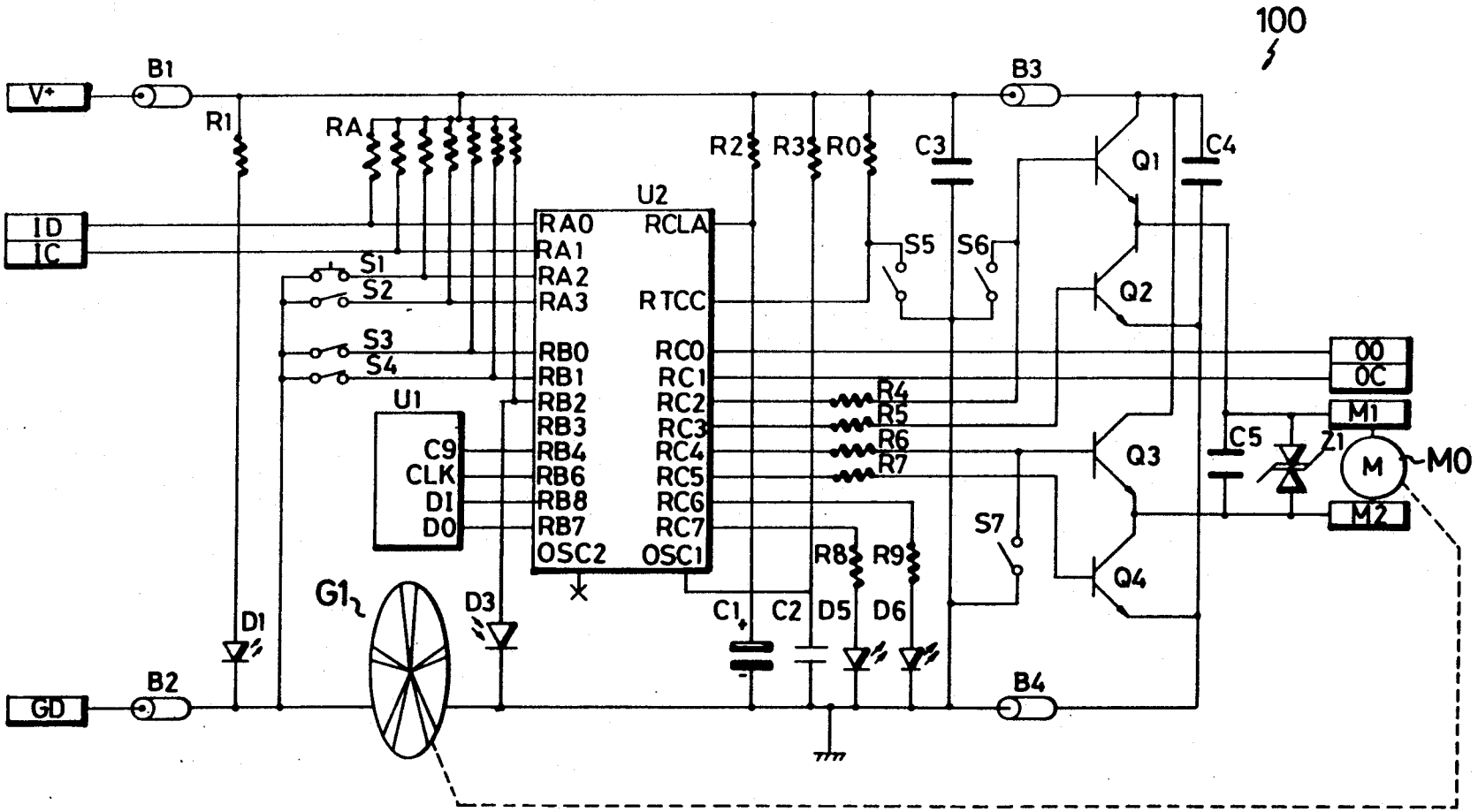
FIG. 1 is a circuit diagram of the control apparatus for a typing/reading device in accordance with the present invention.

Referring to FIG. 1, a control apparatus 100 for a typing/reading aid device 200 is shown in detail. A motor MO which has a positive terminal M1 and a negative terminal M2 is engaged to the ruler (not shown) and moves the ruler up or down along the frame board (not shown). The distance moved by the ruler is proportional to the rotation distance of the motor, which is well known. A disk-like photo-grid G1 is engaged to and synchronously transmitted by the motor M0. A plurality of holes (not labeled) are formed on the disk-like photo-grid G1 allowing light to pass therethrough. A light source D1 is positioned appropriately near the disk-like photo-grid G1 for emitting light therethrough. Actually, the light source D1 is a light emitting diode (LED). The power required by the control apparatus is supplied by a DC power source V+, and all the electrical components listed herein are connected between the power source V+and a ground GD. A first resistor R1 is connected between the power source V+ and the LED D1 for limiting current passing therethrough.

A light sensing means D3 is positioned at one side of the disk-like photo-grid G1 symmetric to the light source D1 about the disk-like photo-grid G1 for responding to light therethrough and generating a chain of pulses. The number of the pulses is proportional to the rotational distance of the disk-like photo-grid G1, and therefore, proportional to the moving distance of the ruler. The light sensing means D3 is a photo-diode which has an anode connected to the power source V+ via one of the pull-up resistors RA, and a cathode connected to ground GD.

A microcontroller means U2 is engaged to the light sensing means D3 for receiving the pulses therefrom. The microcontroller means U2 comprises an internal memory (not shown) for programmably storing data, an input port which further comprises a plurality of input terminals, an output port which comprises a plurality of output terminals, a plurality of bidirectional terminals, and an internal counter for responding to pulses sent to a selected input terminal of the input port and counting the pulses thereto. The microcontroller means U2 could be, for example, an eprom-based 8-bit CMOS microcontroller, provided by Microchip Technology, Inc. Of course, other microcontrollers can be used.

A plurality of parallel pull-up resistors RA are connected between the power source V+and some input terminals of the microcontroller means U2, as will be described in more detail later.

The intersection of the pull-up resistor RA and the photo-diode D3 is further connected to a third input terminal RB2 of the microcontroller means U2. Normally (say the system is powered on), if the motor M0 does not revolve, no pulses are fed to the . microcontroller means U2. However, if the motor M0 is revolving, the photo-grid G1 will intermittently pass light to the photo-diode D3, thereby alternately turning on and off the photo-diode D3, and sending a plurality of pulses to the third input terminal RB2 of the microcontroller means U2.

A second resistor R2 and a first capacitor C1 are serially connected between the power source V+ and the ground GD, with the intersection of the resistor R2 and the capacitor C1 being connected to a reset terminal MCLA of the microcontroller means U2 for resetting the microcontroller when the whole circuit is originally powered on. A third resistor R3 and a second capacitor C2 are serially connected between the power source V+ and the ground GD, with the intersection of the resistor R3 and the capacitor C2 being connected to a clock input terminal OSCl of the microcontroller means U2 for providing system clock signals to the microcontroller means U2.

An external memory means U1 is coupled to the microcontroller means U2 for storing parameter data set by a user. The external memory means U1 can be an AK93C46 erasable programmable memory chip provided by AKM corporation. Of course, other chips are permitted.

A forward-rotation driving means Q1 and Q4 comprising a first transistor Q1 and a fourth transistor Q4 is used to activate the motor M0 to rotate forward when triggered. Hereafter, forward rotation represents clockwise rotation, and backward rotation represents counter-clockwise rotation. When the motor M0 rotates forward (backward), the ruler moves up (down). The first transistor Q1 is coupled between a third output terminal RC2 of the microcontroller means U2 and the positive terminal M of the motor M0. The fourth transistor Q4 is coupled between a sixth output terminal RC5 of the microcontroller means U2 and a negative terminal M2 of the motor M0. When the microcontroller means U2 is programmed to trigger the first transistor Q1 and the fourth transistor Q4 to be on, a first current flows through the power source V+, the first transistor Q1, the motor M0, the fourth transistor Q4, and ground GD, thereby activating the motor M0 to rotate forward (clockwise).

A backward-rotation driving means comprising a second transistor Q2 and a third transistor Q3 is used to activate the motor M0 to rotate backward when triggered. The third transistor Q3 is coupled between a fifth output terminal RC4 of the microcontroller means U2 and the negative terminal M2 of the motor MO. The second transistor Q2 is coupled between a fourth output terminal RC3 of the microcontroller means U2 and the positive terminal M1 of the motor MO. When the microcontroller means U2 is programmed to trigger the third transistor Q3 and the second transistor Q2, a second current flows through the power source V+, the third transistor Q3, the motor M0, the second transistor Q2, and ground GD, thereby activating the motor M0 to rotate backward (counter-clockwise).

A line-space setting switch SI is electrically coupled to the microcontroller means U2 for clearing the internal counter of the microcontroller means U2 if the switch S1 is pressed an odd number of times since the microcontroller means U2 is reset. The line-space setting switch S1 is a push-button switch. If the switch S1 is depressed in an even number of times, since the microcontroller means U2 is reset, then a counted value by the internal counter of the microcontroller means U2 is transferred to the internal memory and the external memory means U1 and stored therein. The function of the switch S1 as mentioned is defined by software control of the microcontroller means U2.

A linearization switch S2 is electrically coupled to the microcontroller means U2 and sends a low signal to the microcontroller means U2 when depressed, causing the microcontroller means U2 to activate the motor M0 to rotate linearly.

A forward switch S3 is electrically coupled to the microcontroller means U2 which is such programmed to cause the forward-rotating driving means Q1 and Q4 to enable the motor M0 to rotate forward when the switch S3 is depressed (ON).

A backward switch S4 is electrically coupled to the microcontroller means U2 which is such programmed to cause the backward-rotation driving means Q2 and Q3 to enable the motor M0 to rotate backward when the switch S4 is depressed.

An upper limit switch S6 is installed at an upper end of the frame board and electrically coupled between the base of the first transistor Q1 and ground GD. When the ruler is moved up, touching/depressing the switch S6 to be ON, grounds the base of the first transistor Q1 and cuts off (de-energizes) the forward driving means Q1 and Q4 thereby stopping the ruler. Switch S6 is a normally open switch, which switches to ON status only when it is depressed by external force, such as a ruler or the like.

A lower limit switch S7 is installed at a lower end of the frame board and is electrically coupled between the base of the third transistor Q3 and ground GD. When the ruler is moved down touching/depressing the switch S7 to be ON, grounds the base of the third transistor Q3 and cuts off (de-energizes) the backward driving means Q3 and Q2, thereby stopping the ruler. Switch S7 is also a normally open switch.

Resistors R4, R5, R6, R7, R8, and R9 are used for current limiting, as is the first resistor R1, and are not described in more detail. Capacitors C3, C4, and C5 are used for noise absorbing, where the capacitors C4 and C5 are used to absorb electrical noise generated by motor M0. A surge absorber Z1 is connected in parallel with the motor M0 for absorbing voltage surges therefrom. Coils B1, B2, B3, and B4 as shown are used for anti-interference.

In practicing, the user must first set the line space by depressing linearization switch S2 so as to put the motor M0 in linear movement mode. Second, the user depresses (turns on) the forward switch S3 or the backward switch S4 to move the ruler up or down to a first line position (defined by the user) and then releases the switch. Third, the user depresses the button switch S1 to reset and initialize the internal counter of the microcontroller means U2 to count the input pulses from input terminal RB2. Fourth, the user depresses (turns on) the backward switch S4 to move the ruler down to a second line defined by the user and releases the switch S4. Fifth, the user depresses the button switch S1 again, which in turn causes the internal counter of the microcontroller means U2 to calculate the number of input pulses and dump the counted value to the internal memory of the microcontroller means U2 and the external memory U1. Since the user has finished line space setting, he may release the linearization switch S2 so as to use the typing/reading aid device 200 in a typing mode. In typing mode, whenever the user depresses the switch S3 (or S4) the ruler will move up (or down) by a line space already set by the user.

Figure 2:
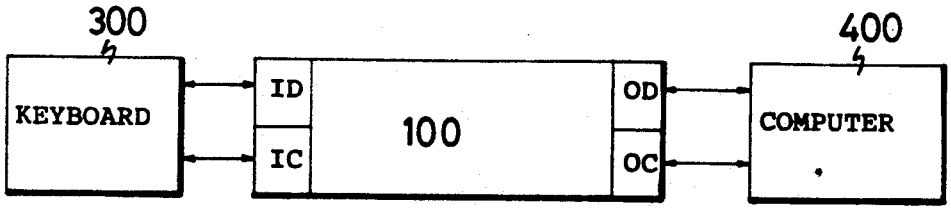
FIG. 2 is a diagram showing the control circuit interfacing between a computer and a keyboard.

The hardware of the second embodiment is almost the same as that of the first embodiment. FIG. 2 is a schematic diagram illustrating the connection of the present invention between a keyboard 300 and a computer 400 (or terminal). Referring to FIG. 1, the switches S1, S2, S3, and S4 are not used in the second embodiment. Instead, the user defines some function keys in the keyboard 300 for fulfilling the corresponding functions as defined by the switches S1, S2, S3 and S4. The detail for setting function (user-defined) keys on a computer keyboard 300 is well known and not described herein. A pull-up resistor RO and a function setting switch S5 are connected in series between the power source V+ and ground GD, with the intersection thereof being connected to an input terminal RTCC of the microcontroller means U2. Normally, the switch S5 remains in OFF state, and a high signal from the power source V+ via resistor RO, is sent to the input terminal RTCC of the microcontroller means U2. If the user wants to set function keys for operating the ruler of the typing/reading aid device 200, he has to depress the switch S5 on, thus transmitting a low signal from ground GD via switch S5 to the input terminal RTCC. Terminals RA0, RA1, RC0, and RC1 are programmed to be bidirectional, where terminals RA0 and RA1 are respectively connected to a keyboard data input terminal ID and a keyboard clock input terminal IC, and terminals RC0 and RC1 are respectively connected to a keyboard data output terminal OD and a keyboard clock output terminal OC. Referring to FIG. 2, the keyboard data input terminal ID is further connected to the data pin of keyboard 300 and the keyboard clock input terminal IC is further connected to the clock pin of keyboard 300. The keyboard data output terminal and the keyboard clock output terminal are respectively connected to the well known interface circuit of a computer 400. If the user wants to set function keys, he depresses the switch S5 (ON), after which, some predetermined data are sent to the computer 400 and shown on a monitor for instructing the user to set function keys, in the mean time the microcontroller means U2 is programmed to block and store the inputted function keys' codes in the external memory U1. Therefore, the function key codes are stored in memory U1 but not transferred to the computer 400. After the user has finished function key setting, he releases the switch S5 (to be OFF), and starts to type by the aid of the typing/reading aid device 200. The microcontroller means U2 is so programmed to compare any inputted key codes with the stored function key codes. If the inputted key codes are different from any stored function key codes, then the microcontroller means U2 will forward the key codes to the computer 400, however if an inputted key code is identical with any stored key code, the inputted key code will not be transferred to the computer 400, and the microcontroller means U2 will respond to the inputted function key codes to enable the motor M0 to function as mentioned in the first embodiment.

A number of flowcharts are shown in FIGS. 3 to 6 to provide a better understanding of the software of this invention.

Figure 3:
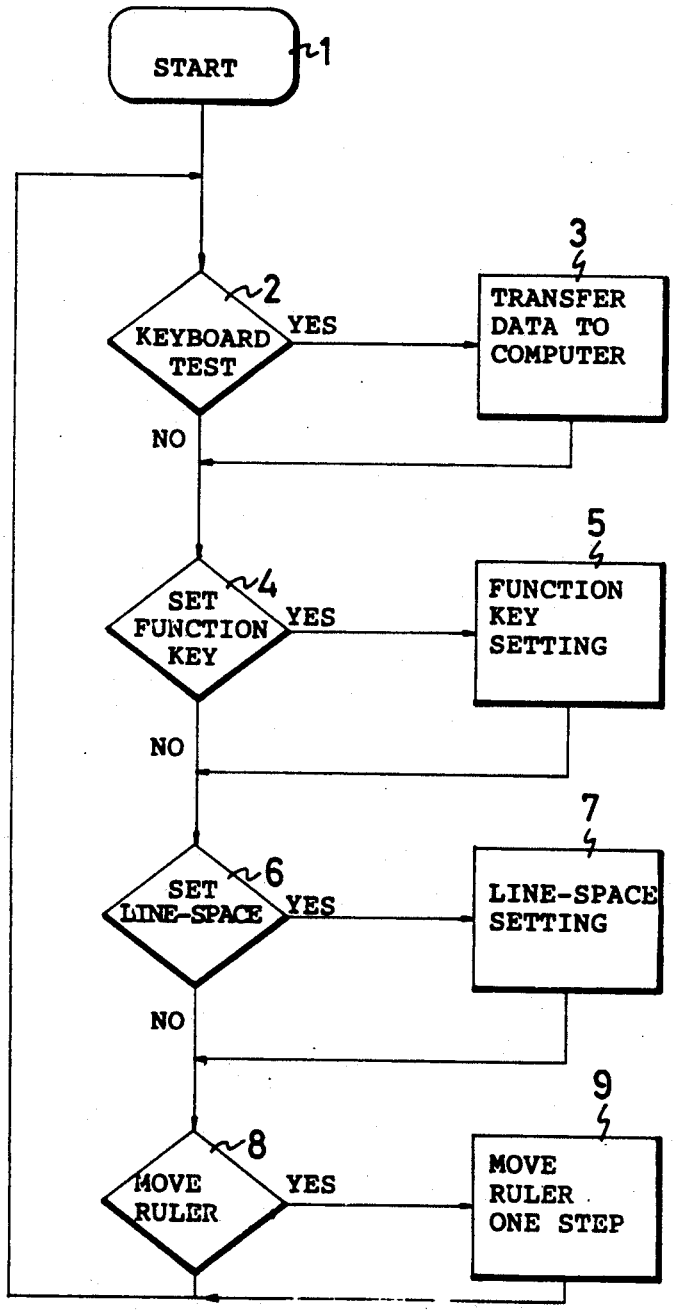
FIG. 3 is a main program of the software used by the present invention.

Referring to FIG. 3, a main program of the software is illustrated. In step 1, the program is initiated and forwarded to decision 2. In decision 2, the microcontroller means U2 tests whether the user is I2 inputting key codes, and if so, the procedure branches to step 3 for transferring the inputted key codes to the computer 400, otherwise it forwards to decision 4. In decision 4, the program checks whether the function key setting switch S5 is depressed, and if so, the procedure branches to step 5 for function key setting, otherwise forwards to decision 6. In decision 6 the program checks whether the user is setting line space (note: the user might utilize switches S1, S2, S3, S4 to set line space or he can utilizes the function keys having the corresponding functions to set line space), and if so, the procedure branches to subroutine 7 to set the line space, otherwise it forwards to decision 8. In decision 8, the program tests whether the forward switch S3 or the backward switch S4 or the corresponding function keys is depressed, and if so, the procedure to subroutine 9, otherwise it loops back to decision 2 and repeats the whole procedure, unless the power source V+ is turned off.

Figure 4:
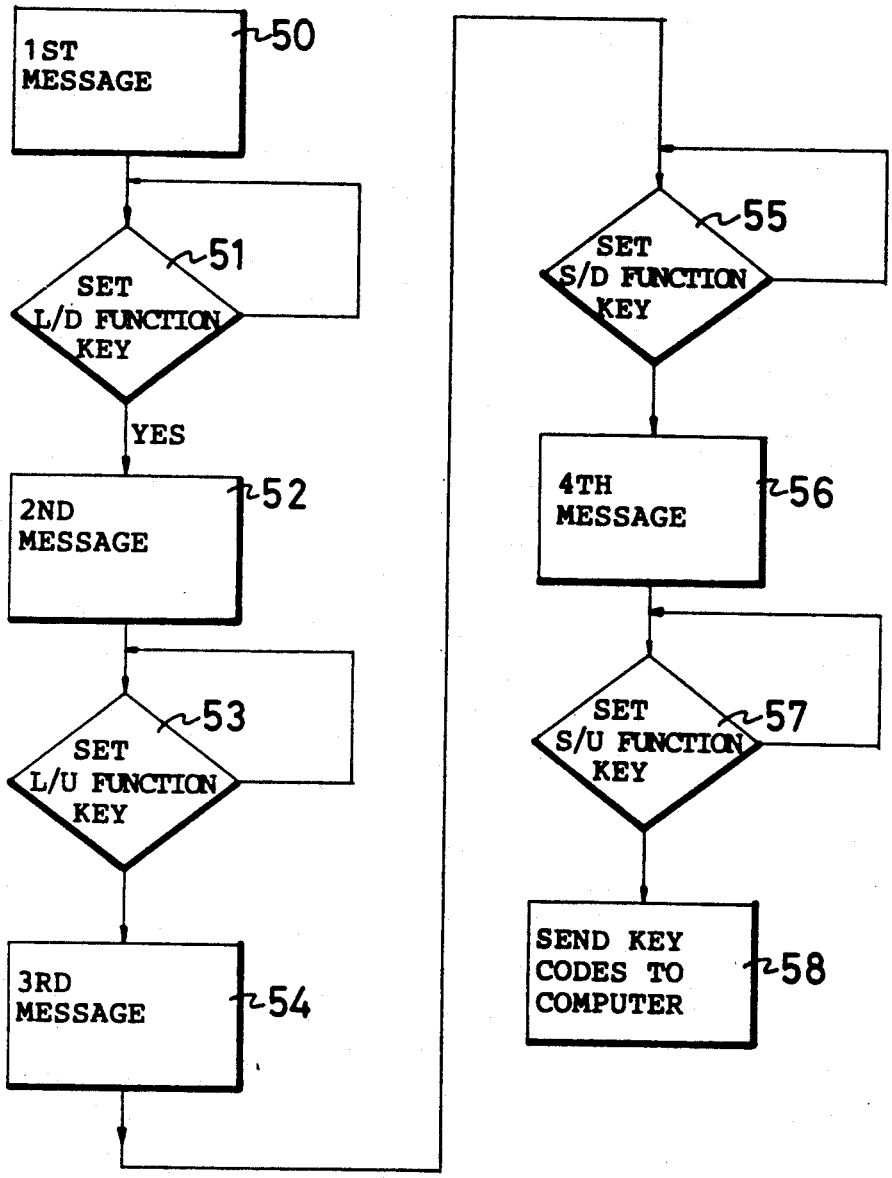
FIG. 4 is function key setting subroutine of FIG. 3.

Referring to FIG. 4, the function key setting subroutine is illustrated. In this subroutine, four functional keys are set as follows. In step 50, a first message is sent from the controller means U2 to a monitor (associated with the computer 400) and instructs the user to set a linear down (L/D) function key. The procedure forwards to decision 51, where the user has to select a key as the linear down function key. Once the L/D function key has been set, the procedure forwards to step 52. In step 52, the key code of linear down function key is stored in external memory U1, and a second message is sent to the monitor to instruct the user to select a key as the linear up (L/U) function key. The procedure forwards to decision 53 to wait for the user to input a key as linear up function key. After the linear up function key has been set, the procedure forwards to step 54. In step 54, the key code of the linear up function key is stored in external memory U1, and the microcontroller means U2 sends a third message to the monitor to instruct the user to select a step down function key. The procedure forwards to decision 55 to wait for the user to input a key as the step down function key. After the step down function key has been set, the procedure forwards to step 56. In step 56, the key code of the step down function key is stored in external memory U1, and a fourth message is sent to the monitor to instruct the user to select a key as the step up function key. The procedure forwards to decision 57 to wait for the user to select a key as the step up function key. After the step up function key has been set, the procedure forwards to step 58. In step 58, the code of the step up function key is stored in external memory U1, and all the codes of the set function keys are sent from the memory U1 to the computer 400. After step 58, the procedure forwards to decision 6 for testing whether the user wants to set line space now. If so (the user must have pressed switch S1 an odd number of times), the procedure is forwarded to Subroutine 7 for line-space setting.

Figure 5:
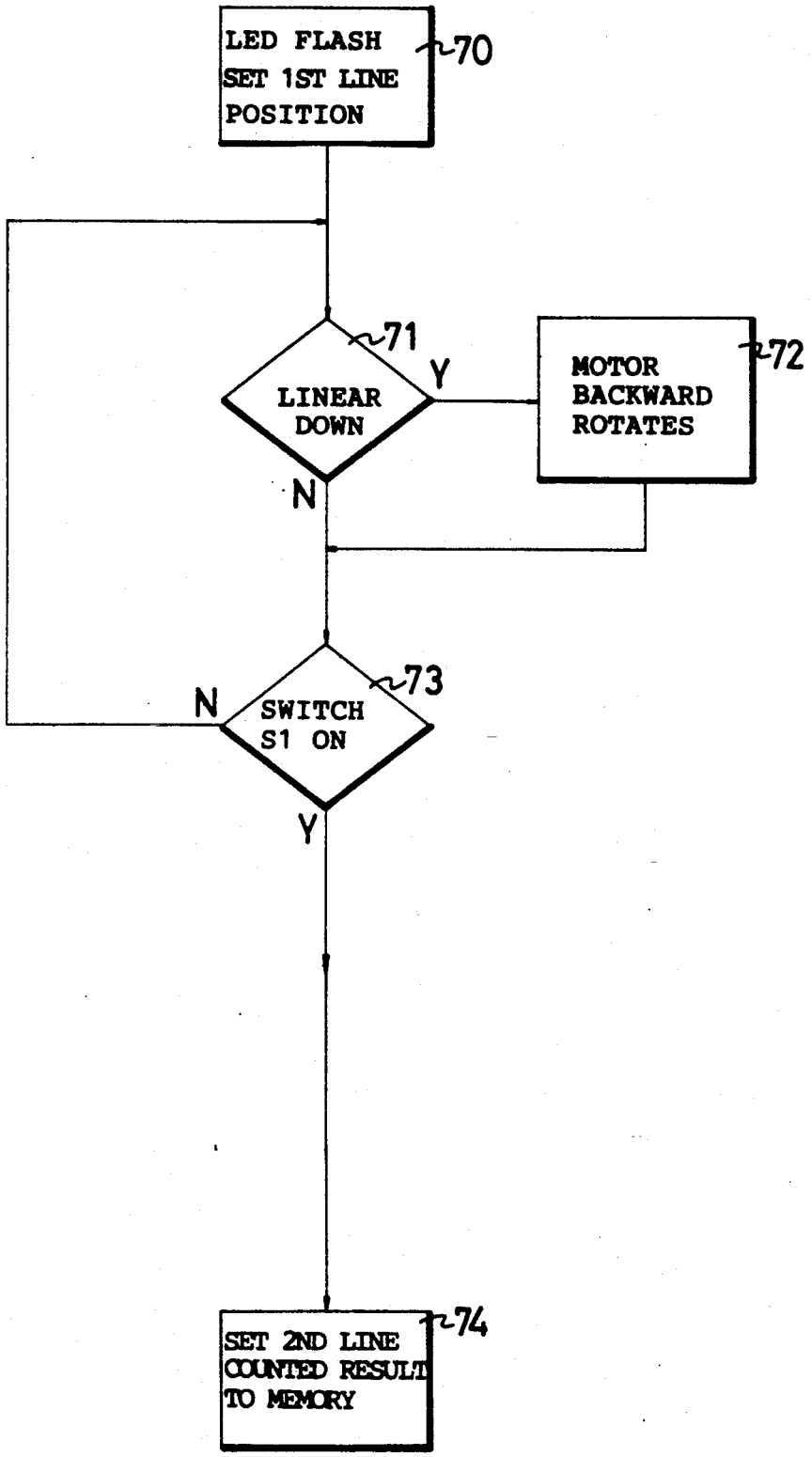
FIG. 5 is a line-space setting subroutine of FIG. 3.

Referring to FIG. 5, the line-space setting subroutine is illustrated. In step 70, the diode D5 flashes, the first line position is determined and the internal counter is initialized. The procedure forwards to decision 71 for testing if the backward switch S4 or the linear down function key is depressed, and if so, the procedure forwards to step 72, otherwise the procedure branches to decision 73. In step 72 the motor is triggered to rotate backward causing the ruler to move down. In decision 73, the program tests whether the line-space setting switch S1 is being depressed, and if so, the procedure forwards to step 74, otherwise it loops back to decision 71. In step 74, the second line position is determined, the internal counter stops counting and dumps the counted result to external memory U1. The procedure then forwards to decision 8 of the main program (FIG. 3). In decision 8, the program tests whether step down/up switches or function keys are depressed (on), and if so, the procedure branches to subroutine 9, otherwise it loops back to decision 2. In subroutine 9, the microcontroller means U2 programmably controls the ruler to step down/up (with a line-space unit) via the motor, as mentioned before.

Figure 6:
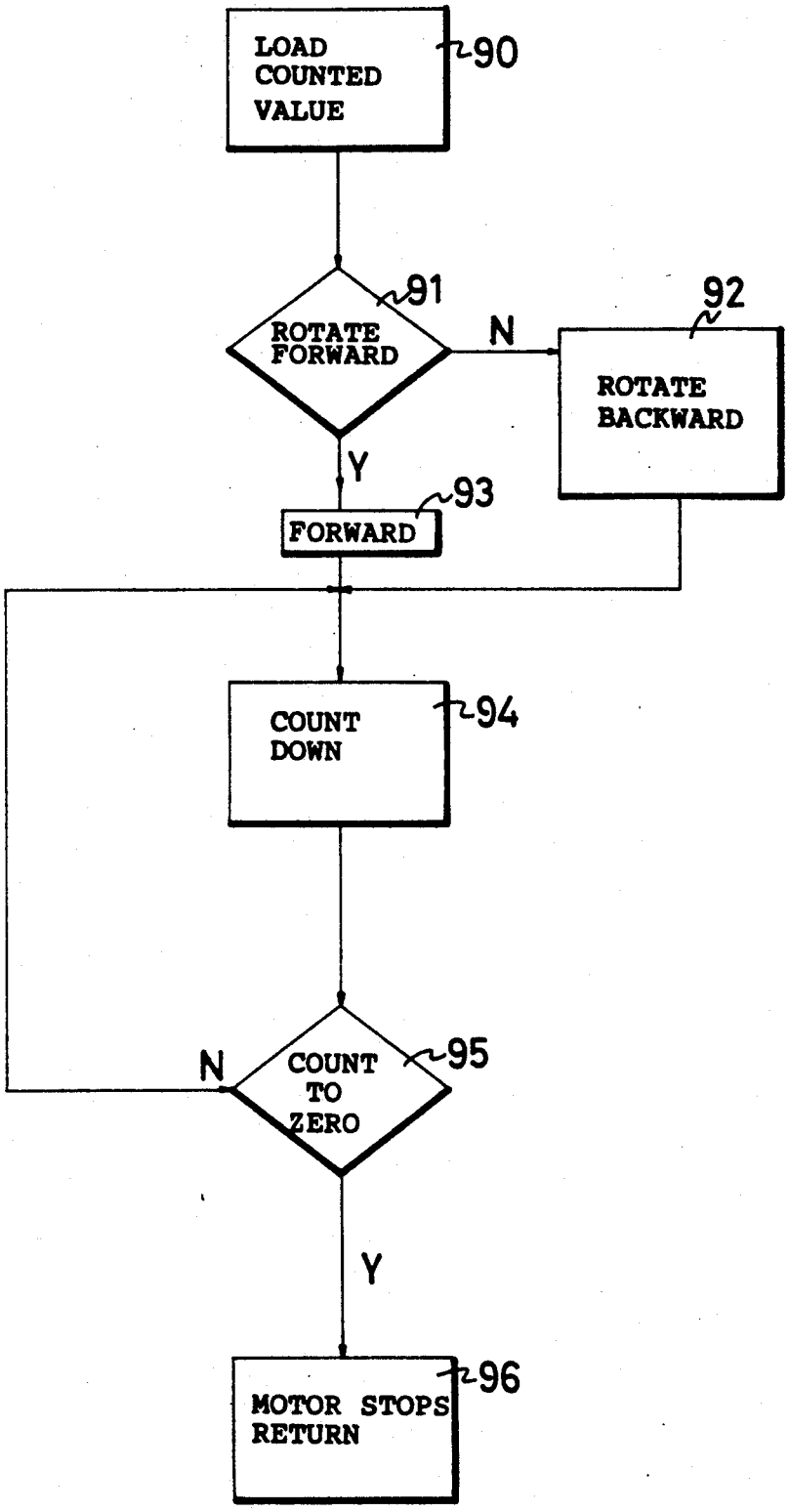
FIG. 6 is a step moving subroutine of FIG. 3.

Referring to FIG. 6, the step moving subroutine is illustrated. In step 90, the program loads the counted value for a line-space from external memory U1 to the microcontroller unit U2. The procedure forwards to decision 91 to test whether input commands are (from switches S3, S4 or from the function keys set by the user) instructing the motor to rotate forward, and if so, forwards to step 93, otherwise it branches to step 92. In step 93, the motor is triggered to rotate forward and the procedure forwards to step 94. In step 92, the motor is triggered to rotate backward and the procedure forwards to step 94. In step 94, the motor keeps rotating and in the mean time the internal counter counts down (decreases the counted value). The procedure forwards to decision 95 to check whether the counter is equal to "0", and if so, the procedure forwards to step 96 to stop the motor, and then loops back to decision 2 (FIG. 3).

The above mentioned description illustrates how the present invention incorporates with a frame board and a ruler. The rotating direction (forward or backward) of the motor and the direction of movement (up or down) of the ruler is not limited to the relation mentioned above; it might be reversed, such that when the motor rotates forward, the ruler moves down. As mentioned above, the ruler is movable and the frame board is stationary. However, the ruler may be stationary and the draft (paper) may be moved by a pair of rollers such as those in a line printer. In this situation, the motor is engaged to the rollers and the present invention is used to control the motor, which in turn controls the movement of the roller. Therefore, although the mechanical structure of a typing/reading aid device 200 is changed, the control apparatus thereof is not changed.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A control apparatus for a typing/reading aid device which includes a ruler slidably mounted on a frame board comprising;

a motor (MO) engaged to said ruler and moving said ruler up or down along said frame boad;

a disk-like photo-grid (G1) engaged to said motor (MO) having a plurality of slots thereof allowing light to pass therethrough;

a light source (D1) in a position near said disk-like photo-grid (G1) for emitting light therethrough;

a light sensing means (D3) arranged in a position opposite to said light source (D1) about said disk-like photo-grid (G1) for responding to light therethrough and generating a chain of electrical pulses;

a microcontroller means (U2) comprising an internal memory for programmably storing data, an input port comprising a plurality of input terminals, an output port comprising a plurality of output terminals, a plurality of bidirectional terminals and an internal counter for responding to pulses sent to a selected input terminal of said input port and counting the pulses thereto;

an external memory means (U1) coupled to said microcontroller means (U2) for storing parameter data set by a user;

a forward-rotation driving means (Q1 and Q4) electrically coupled between a first output terminal of said microcontroller means (U2) and a positive terminal of said motor (MO), for activating said motor to rotate forward when triggered;

a backward-rotation driving means (Q3 and Q2) electrically coupled between a second output terminal of said microcontroller means (U2) and a negative terminal of said motor (MO), for activating said motor (MO) to rotate backward when triggered;

a push-button switch (S1) electrically coupled to said microcontroller means (U2) for clearing said internal counter of said microcontroller means (U2) when said switch (S1) is pressed an odd number of times and for enabling said counted value to be transferred to said internal memory and said external memory means (U1) when said switch (S1) is pressed an even number of times;

a linearization switch (S2) electrically coupled to said microcontroller means (U2) such that when said forward switch(S3) is depressed, said forward-rotating driving means (Q1 and Q4) will enable said motor (MO) to rotate forward;

a forward switch (S3) electrically coupled to said microcontroller means (U2), such that when said forward switch (S3) is depressed, said forward-rotating driving means (Q1 and Q4) will enable said motor (MO) to rotate forward;

a backward switch (S4) electrically coupled to said microcontroller means (U2), such that when said backward switch (S4) is depressed, said backward-rotation driving means (Q2 and Q3) will enable said motor (MO) to rotate backward;

an upper limit switch (S6) being installed at an upper end of said frame board such that when said upper limit switch (S6) is depressed by said ruler, said forward rotation driving means (Q1 and Q4) are de-energized thereby stopping said motor (MO) and further stopping said ruler;

a lower limit switch (S7) being installed at a lower end of said frame board such that when said lower limit switch (S7) is depressed, said backward-rotation driving means (Q2 and Q3) are de-energized thereby stopping said motor (MO) and further stopping said ruler;

said control apparatus (100) being coupled between a keyboard (300) and a computer (400), and having a pull-up resistor (RO) and a function setting switch (S5) connected in series between and power source (V+) and a ground (GD), with the intersection thereof being connected to an input terminal (RTCC) of the microcontroller means (U2), such that the function setting switch (S5) is depressable to cause a low signal from the ground (GD) to the input terminal (RTCC), which in turn triggers a corresponding program for setting function keys for the keyboard (300) and store the set function key codes in the external memory (U1); said microcontroller means (U2) being programmed to compare any inputted key codes with the stored function key codes, and the microcontroller means (U2) forwards the key codes to the computer (400) when the inputted key codes are different from any stored function key codes, otherwise, the microcontroller means (U2) will respond to the inputted function key codes to execute a specific function as defined by said inputted function key codes.

* * * * *